United States Patent [19]

Peterson

[11] Patent Number: 4,996,008

[45] Date of Patent: Feb. 26, 1991

[54] COOLING TOWER LIQUID CONTACT PLATE SUPPLY SYSTEM

[76] Inventor: Charles A. Peterson, 2201 Lord Ashley Dr., Sanford, N.C. 27330

[21] Appl. No.: 467,959

[22] Filed: Jan. 22, 1990

[51] Int. Cl.[5] ..... B01F 3/04

[52] U.S. Cl. ..... 261/111

[58] Field of Search ..... 261/111

[56] References Cited

U.S. PATENT DOCUMENTS

| | | | |
|---|---|---|---|
| 3,751,017 | 8/1973 | Lemmens | 261/111 |
| 4,396,559 | 8/1983 | Nutter | 261/112.1 |
| 4,451,411 | 5/1984 | Lefevre | 261/111 |
| 4,477,394 | 10/1984 | Armstrong et al. | 261/112 |
| 4,728,468 | 3/1988 | Duke | 261/111 |
| 4,868,956 | 9/1989 | Shepherd | 261/111 |

FOREIGN PATENT DOCUMENTS

| | | | |
|---|---|---|---|
| 747455 | 3/1970 | France | 261/111 |

*Primary Examiner*—Tim Miles

*Attorney, Agent, or Firm*—Olive & Olive

[57] ABSTRACT

A liquid cooling tower construction incorporates a tower fill assembly with liquid contact plates which interconnect in abutting relation by use of detachable connectors formed on the sides of the liquid contact plates.

6 Claims, 4 Drawing Sheets

COOLING TOWER LIQUID CONTACT PLATE SUPPORT SYSTEM

BACKGROUND OF INVENTION

1. Field of Invention

The invention relates to a liquid cooling tower of the type in which the liquid to be cooled flows downwardly within the tower through a series of vertically spaced grid or lattice-like structures referred to here as liquid contact plates and more specifically relates to an improved liquid contact plate support system.

2. Background Art

In the general mode of operation of a cooling tower, a fan in the top of the cooling tower is actuated and draws air in through an opening at the base of the tower and upwardly through the tower to be exhausted to the atmosphere. Water at a relatively high temperature is fed into the top of the tower in a convenient manner. The water falls under the action of gravity through what is referred to as the tower fill assembly and is collected at the bottom of the tower. The decending water is contacted by the upwardly flowing atmosphere air which cools the water and enables the water to be reintroduced into an air conditioning system or other process using the water at a lower temperature than that at which the water entered the cooling tower. The present invention is primarily directed to the construction of the liquid contact plates which make up the cooling tower fill assembly and more specifically to a construction which enables the liquid contact plates to be interconnected and supported as an integral assembly at each tier level within the cooling tower.

In one type of support system, the liquid contact plates are joined to each other by a type of bracket such as shown in U.S. Pat. No. 3,751,017. A plurality of liquid contact plates are operatively connected together by the brackets at the different elevations and are effectively stacked one liquid contact layer above the other in a tier-like arrangement. A plurality of laterally spaced flexible strands are supported from the top of the tower and passed through the various tiers of liquid contact plates. Suitable clamps are secured below the liquid contact plates to support the tier of contact plates above. The use of brackets to join the liquid contact plates together at each tier level has not proven satisfactory for many reasons among which has been the need for a very large quantity of brackets and the lack of providing a secure attachment for holding the various liquid contact plates in a particular tier level together.

While fluid contact plates have been interconnected in vertical arrays as in U.S. Pat. No. 4,728,468, so far as applicant is aware, it has not been previously known to form liquid contact plates so as to eliminate the need for the corner brackets while permitting the sides of the liquid contact plates to be abutted and interconnected one with the other to form relatively rigid tiers of liquid contact plates one above the other. Providing an improved liquid contact plate which permits the sides of one liquid contact plate to be detachably but firmly connected to the sides of surrounding liquid contact plates becomes the principle object of the invention. Other objects will become apparent as the description proceeds.

SUMMARY OF INVENTION

A liquid contact plate according to the invention is molded as an integral piece. Each side of the liquid contact plate is molded with a series of supports which mate with and interengage support elements on the side of another liquid contact plate. Thus, in each tier level, the liquid contact plates making up that tier level are effectively locked together but in a manner which enables the individual liquid contact plates to be detachably removed whenever necessary.

DESCRIPTION OF PREFERRED EMBODIMENT

As will be apparent from the description to follow, the present invention is primarily directed to the construction of the individual liquid contact plates such that a plurality of individual liquid contact plates made according to the invention can be interconnected together to form an integral layer of liquid cooling elements as part of a tier or one of a stack of liquid cooling elements in a cooling tower. Before proceeding to the detailed description of the liquid contact plate construction to which the invention is primarily directed reference will be made to FIG. 9.

Figure 9:
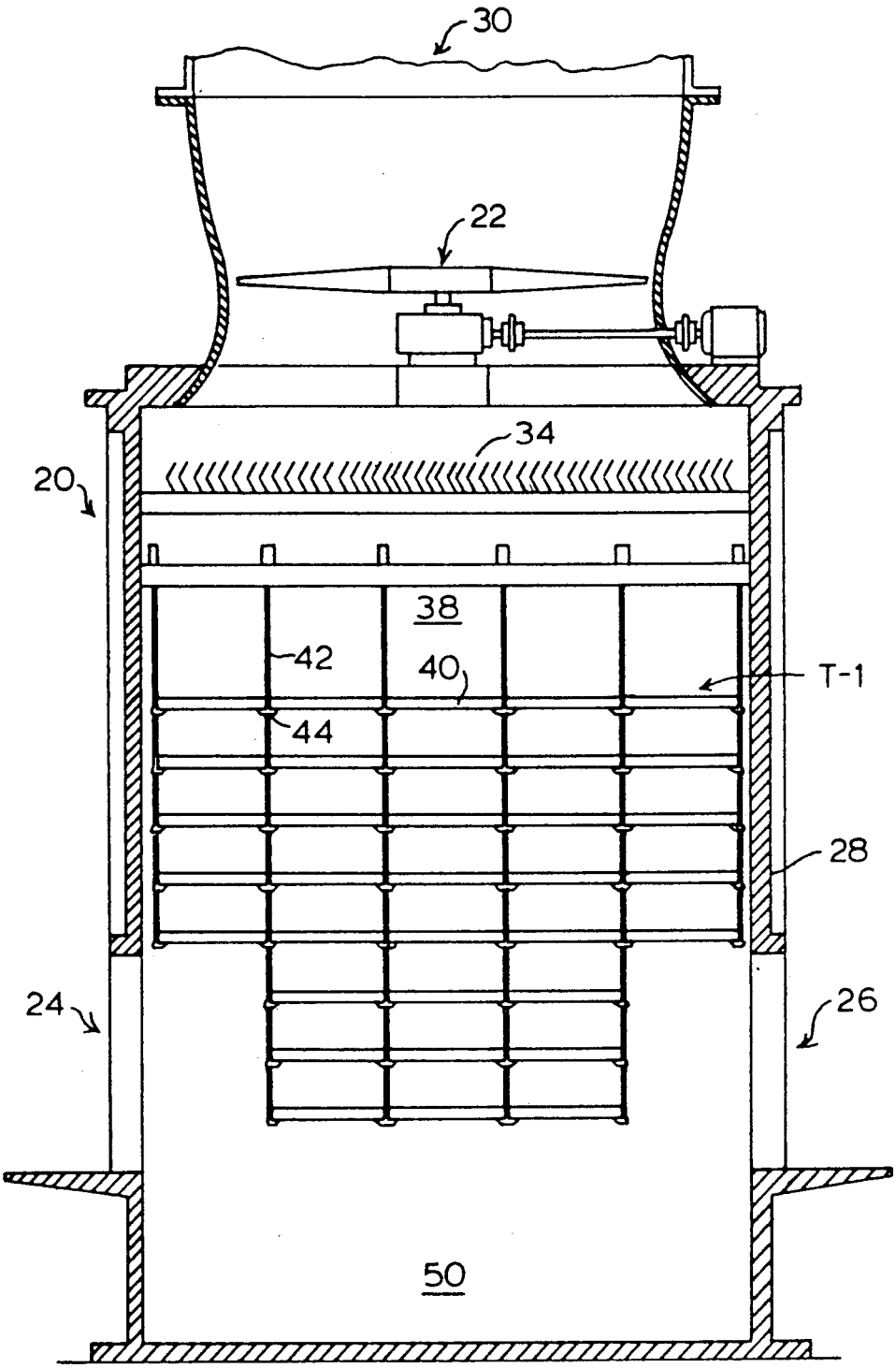
FIG. 9 is an elevational cross section view of a cooling tower containing an array of vertically displaced tiers of liquid contact plates according to the invention.

In the general operation of a cooling tower 20 as depicted in FIG. 9, the fan 22 draws air in through the openings 24–26 at the base of the tower housing 28. The air passes upward through the tower and exits through the nozzle 30 to the atmosphere. Water at a relatively high temperature is fed into the top of the tower by a suitable distributor, generally designated 34, and falls under the action of gravity through the cooling tower fill assembly 38 made up of the individual liquid contact plates, generally designated 40, according to the invention. Each tier of liquid contact plates such as the designated tier T-1 in FIG. 9 is supported by a plurality of flexible vertical strands 42 which pass through suitably formed grooves 43 (FIG. 6) in the liquid contact plates as later explained with each tier being supported by appropriate clamps 44 secured to the strands 42 below particular adjoining liquid contact plates 40. The upwardly flowing air cools the water and the water collects in the basin 50 where it becomes available for being reintroduced into the air conditioning system or other liquid using process at a lower temperature than that at which the water entered the cooling tower.

Referring next primarily to FIGS. 1–8, each liquid contact plate 40 made according to the invention is molded as an integral unit and preferrably is of a square shape, about two feet by two feet in size and approximately one and one-half pounds in weight. Each individual liquid contact plate 40 may have a thickness of approximately one to two inches depending on the application. Molded ribs 52 support a lattice-like liquid cooling, perforate grid made up of molded intersecting strips 54, 56 with strips 56 residing on top of strips 54 though other forms of lattice-like grids and other dimensions may be substituted for that described.

Figure 1:
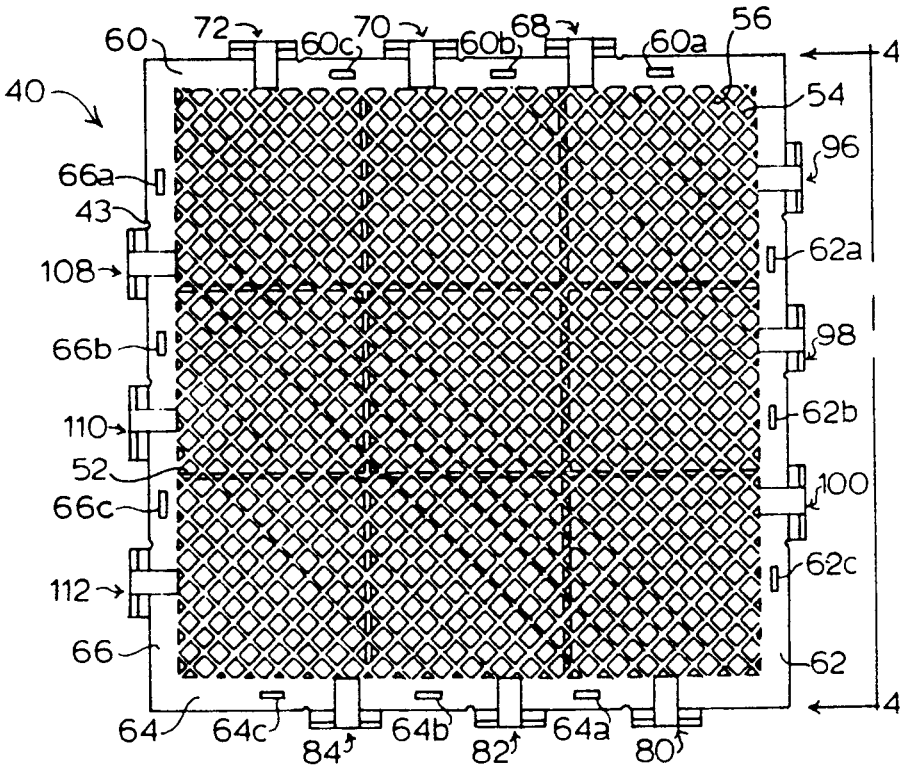
FIG. 1 is a top plan view of the liquid contact plate according to the invention.
Figure 2:
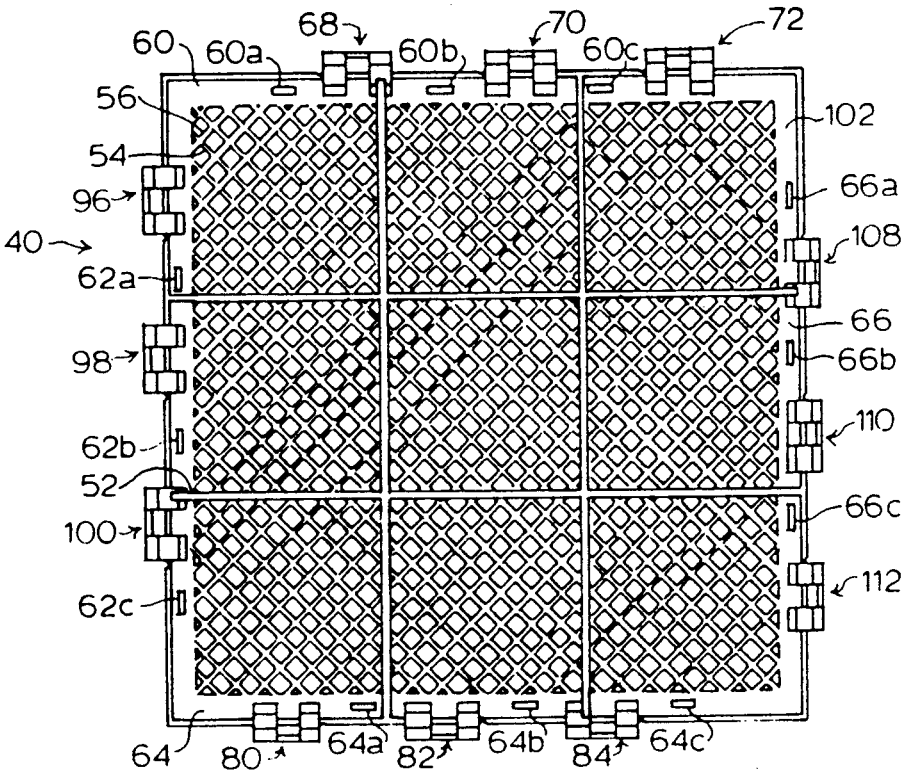
FIG. 2 is a bottom plan view of the liquid contact plate shown in FIG. 1.
Figure 3:
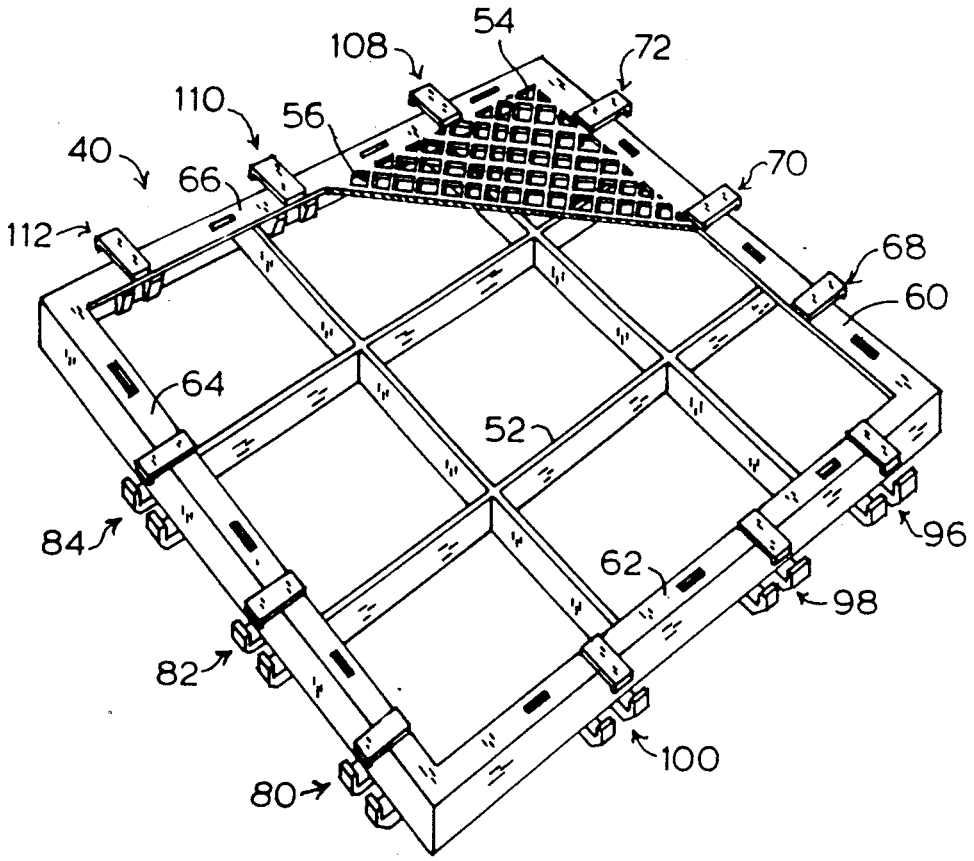
FIG. 3 is a perspective view of the liquid contact plate of FIG. 1 with portions of the grid or lattice work eliminated for purposes of illustration.
Figure 4:
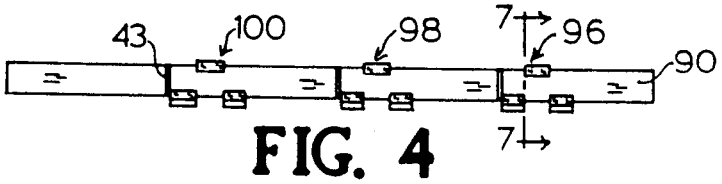
FIG. 4 is a end view taken in the direction of line 4—4 of FIG. 1.
Figure 6:
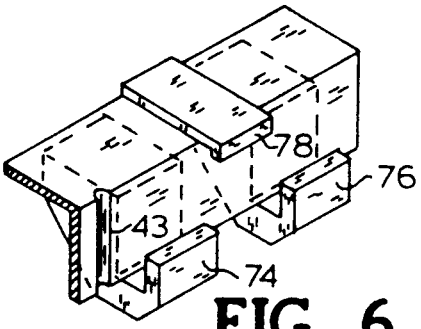
FIG. 6 is a partial perspective view of one of the snap fitted latch and support configurations as used on the sides of the liquid contact plates of the invention.
Figure 7:
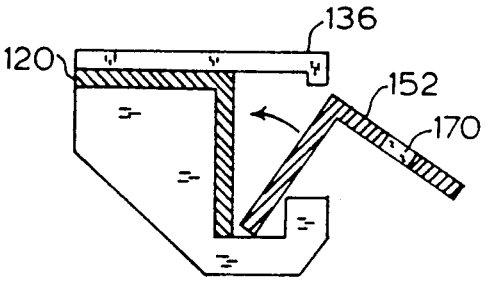
FIG. 7 illustrates the side of an illustrative liquid contact plate made according to the invention being snap fitted to the side of another illustrative liquid contact plate made according to the invention using the support system of the invention.
Figure 8:
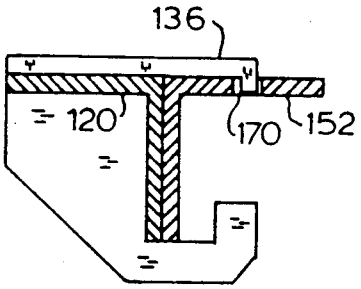
FIG. 8 shows the illustrative assembly of FIG. 7 snap fitted together.

Making special reference to FIGS. 1–3, the molded sides 60, 62, 64 and 66 are formed so as to have right angle cross section as best seen in FIGS. 6–8. Each side is formed with a plurality of latch holes such as holes 60*a*, 60*b*, and 60*c* in side 60. The opposite side, for example side 64, of each liquid contact plate 40 is formed with another series of latch holes 64*a*, 64*b* and 64*c* which are slightly displaced from the directly opposite position. That is, it will be noted that latch hole 64*a*, for example, rather than being directly opposite latch hole 60*a* in FIG. 2 is slightly displaced from such opposite position. In a similar manner it will be noted that latch hole 64*b* is displaced from the position which would be opposite latch hole 60*b* and latch hold 64*c* is displaced from the position which would be opposite latch hole 60*c*. With continuing reference to FIGS. 1 and 2, it will be noted that side 60 also has three integrally formed connectors 68, 70 and 72 each of which as best seen in FIG. 6 comprises a pair of laterally spaced supports 74, 76 and a snap fitting latch 78. In a similar manner, side 64 has a series of connectors 80, 82 and 84 and as illustrated in FIGS. 1 and 2 are displaced from the positions which would otherwise be directly opposite the connectors 68, 70 and 72 in side 60.

Using the preceding description as a reference, it will also be noted that side 62 has a series of latch holes 62*a*, 62*b* and 62*c* and a series of connectors 96, 98, 100. Likewise, side 66 has a series of latch holes 66*a*, 66*b* and 66*c* and a series of connectors 108, 110, 112. The latch holes 62*a*, 62*b* and 62*c*, in side 62 are displaced from the latch holes 66*a*, 66*b* and 66*c* in side 66 in the manner previously explained. In a similar manner, the connectors 96, 98 and 100 on side 62 are displaced from the connectors 108, 110 and 112 on side 66.

Figure 5:
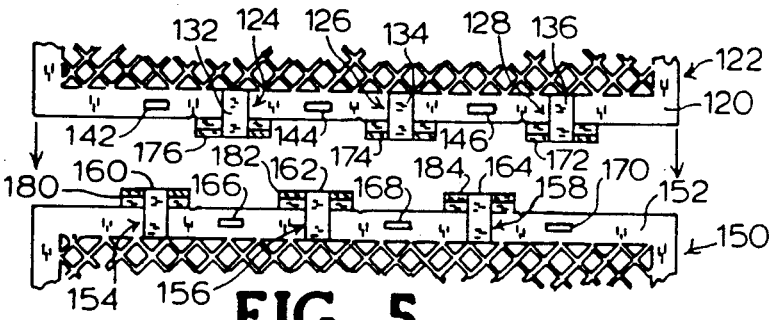
FIG. 5 is a partial top plan view of one side of a liquid contact plate made according to the invention approaching another mating side of a liquid contact plate made according to the invention to perfect an interconnection between the plates, the connectors on one plate being offset with respect to the connectors on the opposite plate to facilitate such interconnection.

FIG. 5 illustrates how two illustrative liquid contact plates are interconnected by bringing two sides of the plates together which have displaced connectors and latch holes and latching one side to the other. In FIG. 5, side 120 of illustrative liquid contact plate 122 is illustrated as having a series of connectors 124, 126, 128 formed in the manner of FIG. 6 and with respective latch members 132, 134 and 136. The illustrative side 120 in FIG. 5 is also illustrated as having a series of latch holes 142, 144, 146. Opposite side 120 in FIG. 5 there is illustrated another representative liquid contact plate 150 having a side 152 on which is formed connectors 154, 156, 158 in the manner of FIG. 6 and with respective latch members 160, 162 and 164. As further illustrated in FIG. 5, latch member 160 on side 152 mates with latch hole 142 in side 120. In similar manner, latch member 132 on side 120 mates with latch hole 166 in side 152. Correspondingly, latch member 162 on side 152 mates with latch hole 144 in side 120. Latch member 134 on side 120 mates with latch hole 168 on side 152 and latch member 164 on side 152 mates with latch hole 146 in side 120. Finally, in this illustrative example, latch member 136 on side 120 mates with latch hole 17 in side 152.

As further illustrated in FIGS. 7 and 8, when the illustrative side 152 is nested in the supports 172, 174 and 176 on side 120 and the illustrative side 120 is nested in the supports 180, 182, 184 of side 152, latch member 136 is latched into latch hole 170, latch member 164 is latched into latch hole 146, latch member 134 is latched into latch hole 168, latch member 162 is latched into latch hole 144, latch member 132 is latched into latch hole 166 and latch member 160 is latched into latch hole 142 to complete a series of snap fit interconnections such as illustrated in FIG. 8 thereby firmly securing the side 120 of the representative liquid contact plate 122 to a mating side 152 of the liquid contact plate 150 both of which are partially illustrated in FIG. 5. Each side preferably has a right angle cross section with respective vertical and horizontal leg portions as best seen in FIGS. 6–8. The vertical leg portion of one side thus substantially abuts and is supported by the connectors on the opposite side to which such one side is secured.

From the foregoing, it is to be understood that all of the liquid contact plates in each tier level are interconnected in the manner described. Thus, at each tier level the liquid contact plates present a substantially integral cooling assembly.

In summary, it can be seen that the liquid contact plate construction of the invention enables each liquid contact plate in each layer or tier of liquid contact plates to be interconnected to all other surrounding liquid contact plates. Each layer or tier thus effectively becomes an integral filtering element but with the ability to quickly disassemble either a portion or all of such layer or tier. The need for corner brackets has also been eliminated.

I claim:

1. A liquid cooling tower construction, comprising:

(a) a housing formed for receiving air at one location and exhausting air at another location;

(b) a plurality of liquid contact plates in each of a series of vertically spaced horizontal tiers and positioned within the housing so as to permit air to contact liquid flowing through said plates while said liquid trickles downwardly from the upper to the lower of said tiers;

(c) said liquid contact plates being constructed and arranged so that the sides of each liquid contact plate are in substantially abutting relation with the sides of all adjoining liquid contact plates and are detachably secured thereto by snap fitted connecting means formed integral with the respective sides of the liquid contact plates in such abutting relationship; and (d) wherein each of the sides of said liquid contact plates are formed with a right angle cross sectional shape with respective vertical and horizontal leg portions, and support means on each of said sides adapted to engage and support the vertical leg portion of an abutting side of another liquid contact plate, and securing means extending from one abutting side engaging holes in the other abutting side in a snap fit relation.

2. A liquid cooling tower construction as claimed in claim 1 wherein said connecting means include for each of the pair of abutting sides of the liquid contact plates support means integral with the respective sides for receiving and supporting the other of the sides and latch securing means extending from each respective side formed to detachably engage the other of the sides to maintain the pair of sides in abutting relation and the liquid contact plates associated with the pair of abutting sides in a common horizontal plane with other liquid contact plates in the same tier, said support latch securing means on one respective side being offset from the support and 3. A liquid cooling tower construction as claimed in claim 1 wherein said liquid contact plates are each molded as an integral structure including the connecting means associated therewith.

4. A liquid cooling tower construction as claimed in claim 1 wherein said liquid contact plates are each molded as an integral structure including the connecting means associated therewith.

5. A liquid cooling tower construction as claimed in claim 1 wherein said connecting means include for each of the pair of abutting sides of the liquid contact plates support means integral with the respective sides for receiving and supporting the other of the sides and latch securing means extending from each respective side formed to detachably engage the other of the sides to maintain the pair of sides in abutting relation and the liquid contact plates associated with the pair of abutting sides in a common horizontal plane with other liquid contact plates in the same tier, said support latch securing means on one respective side being offset from the support and latch securing means on the other side.

6. A liquid cooling tower construction, comprising:

(a) a housing formed for receiving air at one location and exhausting air at another location;

(b) a plurality of liquid contact plates in each of a series of vertically spaced horizontal tiers and positioned within the housing so as to permit air to contact liquid flowing through said plates while said liquid trickles downwardly from the upper to the lower of said tiers;

(c) said liquid contact plates being constructed and arranged so that the sides of each liquid contact plate are in substantially abutting relation with the sides of all adjoining liquid contact plates and are detachably secured thereto by snap fitted connecting means formed integral with the respective sides of the liquid contact plates in such abutting relationship; and (d) wherein said connecting means include for each of the pair of abutting sides of the liquid contact plates support means integral with the respective sides for receiving and supporting the other of the sides and latch securing means extending from each respective side formed to detachably engage the other of the sides to maintain the pair of sides in abutting relation and the liquid contact plates associated with the pair of abutting sides in a common horizontal plane with other liquid contact plates in the same tier, said support latch securing means on one respective side being offset from the support and latch securing means on the other side.

* * * * *